US005346021A

United States Patent [19]

Braunlich

[11] Patent Number: 5,346,021

[45] Date of Patent: Sep. 13, 1994

[54] FASTENING TOOL HAVING IMPROVED PRESSURE REGULATOR DEVICE

[75] Inventor: Mark F. Braunlich, Willoughby, Ohio

[73] Assignee: The Stanley Works, New Britain, Conn.

[21] Appl. No.: 58,381

[22] Filed: May 10, 1993

[51] Int. Cl.[5] ..... B25B 23/145

[52] U.S. Cl. ..... 173/177

[58] Field of Search ..... 173/176, 177, 178, 135

[56] References Cited

U.S. PATENT DOCUMENTS

| | | | |
|---|---|---|---|
| 3,373,824 | 3/1968 | Whitehouse . | |
| 3,505,928 | 4/1970 | Whitehouse | 173/177 |
| 3,786,873 | 1/1974 | Whitehouse . | |
| 3,920,088 | 11/1975 | Dudek | 173/177 |
| 3,970,151 | 7/1976 | Workman, Jr. | 173/176 |
| 4,434,858 | 3/1984 | Whitehouse | 173/177 |
| 4,903,783 | 2/1990 | Rushanan et al. | 173/177 |
| 4,991,663 | 2/1991 | Steverding | 173/177 |

OTHER PUBLICATIONS

"A Primer on Setting Threaded Fasteners" by Hugh L. Whitehouse, Revised May 25, 1991.

*Primary Examiner*—Scott A. Smith

*Attorney, Agent, or Firm*—Hayes & Reinsmith

[57] ABSTRACT

An air tool for setting fasteners includes a pressure selecting valve member and internal passages for air balancing this valve member with a pressure relief pilot valve for bleeding a chamber of the valve member to atmosphere responsive to increased motor operating pressure. A plurality of such pilot valves may be provided in a manually rotatable selector disc. Each pilot valve may be set to a different torque output for quick and easy tool adjustment upon registering a given pilot valve with the pressure selecting valve chamber upon manipulation of the selector disc.

13 Claims, 4 Drawing Sheets

FASTENING TOOL HAVING IMPROVED PRESSURE REGULATOR DEVICE

FIELD OF THE INVENTION

This invention generally relates to air tools and particularly concerns air operated tools for setting threaded fasteners such as nutsetters, screw drivers, and the like incorporating controls for regulating motor operating pressure.

BACKGROUND OF THE INVENTION

Power tools such as an air powered screw driver, nutsetter, or similar air operated tool frequently depend on shutoff devices responsive to sensing motor pressure, which is low when the tool is running free, and which rises as the tool is loaded. I.e., in a given tool, torque is a positive function of air pressure. Increasing pressure increases torque. In an air tool, torque is a negative function of speed, and this function is linear. When setting a fastener, e.g., as torque builds up, speed goes down; when speed is zero or at stall, torque is highest.

To control maximum motor operating pressure, a stall torque regulator has been known to be located in the tool at a motor inlet.

OBJECTS OF THE INVENTION

A principal object of this invention is to provide a new and improved air powered fastener setting tool with a pressure regulator having a pressure selecting valve member which is initially air balanced and biased into open position by a small light spring. Included in this object is the aim of providing such an air tool which is of simplified, relatively lightweight construction capable of reliable performance over a wide pressure adjustment range.

Another object of this invention is to provide a new and improved air powered fastener setting tool which features a selectable set torque device which is quick and easy to use.

Other objects will be in part obvious and in part pointed out in more detail hereinafter.

SUMMARY OF THE INVENTION

The air powered fastener setting tool of this invention includes a pressure regulator having a pressure selecting valve member reciprocal in a valve chamber between relatively open and restricted positions. A spring is mounted in the chamber biasing the valve member toward open position, and passage means are provided for directing air pressure on the motor side of the valve member against its opposite ends such that it is initially air balanced. A pressure relief pilot valve connects the chamber with atmosphere and creates a pressure differential between opposite ends of the pressure selecting valve member for moving it toward its restricted position responsive to increased motor operating pressure to restrict the outlet port and reduce air pressure on the motor side of the regulator. In addition, this invention contemplates a plurality of such pressure relief pilot valves for connecting the valve chamber with atmosphere. Each of the pilot valves is adjusted to a different specified mean output torque setting such that a manually operated selector is selectively registrable with any one of the pressure relief pilot valves for connecting the valve chamber with atmosphere and quickly establishing a previously adjusted specified mean output torque for the tool.

A better understanding of the objects, advantages, features, properties and relations of the invention will be obtained from the following detailed description and accompanying drawings which set forth certain illustrative embodiments and are indicative of the various was in which the principles of the invention are employed.

DETAILED DESCRIPTION OF THE PREFERRED EMBODIMENTS

Figure 1:
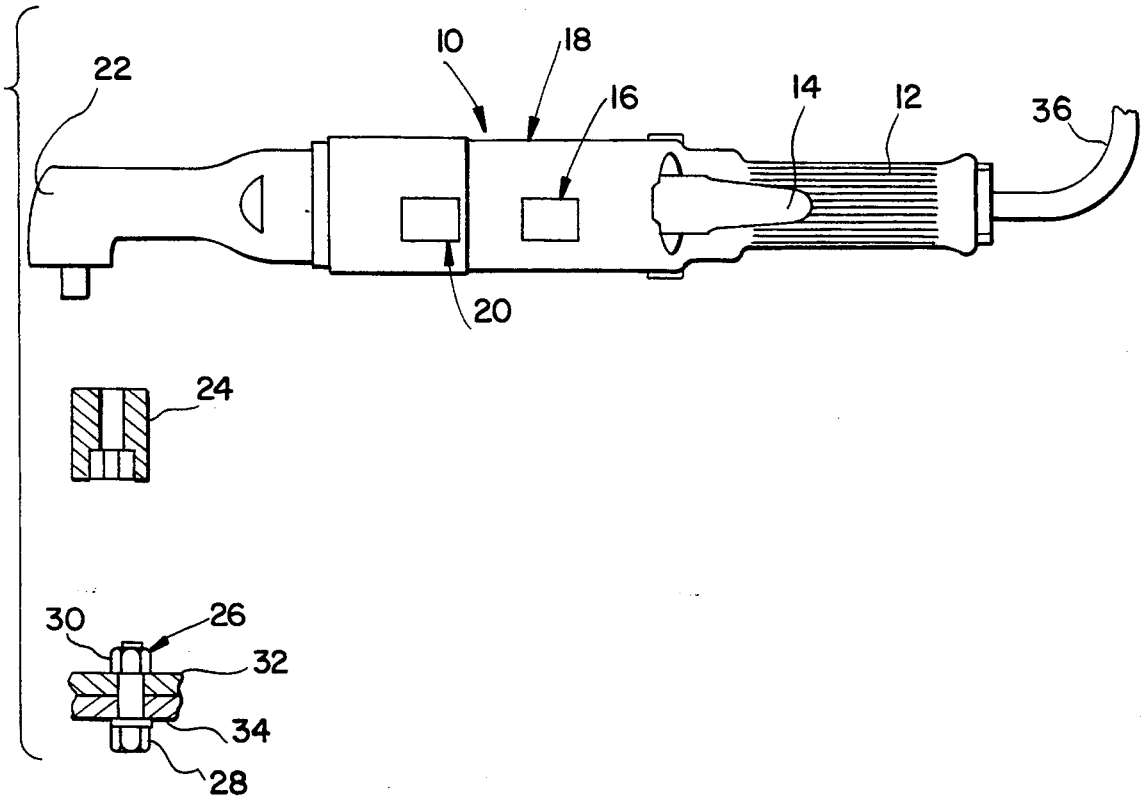
FIG. 1 is a schematic view, partly broken away, showing an air operated tool incorporating this invention.

Referring now to the drawings in detail, power tool 10 is a rotary air operated tool for use in setting screws, nuts and other threaded fasteners. Typically, tool 10 (FIG. 1) has a hand grip 12, an on-off control switch operator 14, a high speed rotary multiple vane air motor 16 mounted within a cylindrical housing 18 with a planetary gear reduction 20 to reduce speed and increase torque, and an output drive 22 to connect to a socket 24 for tightening a fastener 26. The latter comprises a threaded bolt 28, e.g., and nut 30 which fits within socket 24 wherein sheets 32, 34 of a workpiece may be joined in a typical fastening job. Compressed air from a suitable source, not shown, is fed to a supply line 36 coupled to housing 18 for driving the air motor 16, and air flow is controlled by any suitable on-off control such as throttle valve 38 (FIG. 2).

Figure 2:
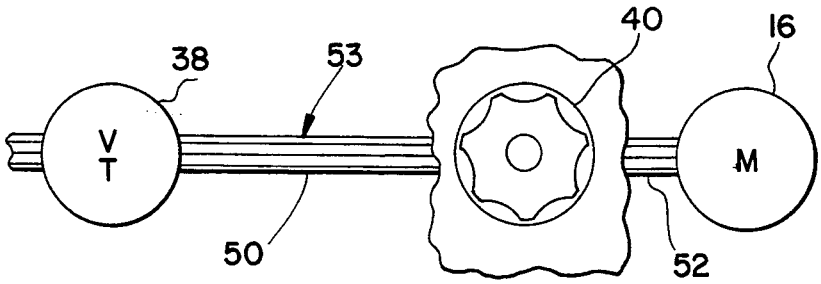
FIG. 2 is a schematic view, partly broken away, showing a pressure selecting valve of this invention interposed in an air supply line between an air operated motor and an on-off control.

To regulate the torque output of tool 10 for running fastener 26 within a desired torque range, a pressure regulator 40 is mounted in the housing 18 between throttle valve 38 and motor 16 (FIG. 2). Pressure regulator 40 includes a valve chamber 42 (FIG. 3) which is formed in part by a sleeve 44 having an inlet port 46 and an outlet port 48 communicating with portions 50 and 52 of an air supply passageway 53 (FIG. 2) formed in housing 18 and respectively connected to the throttle valve 38 and motor 16.

Figure 3:
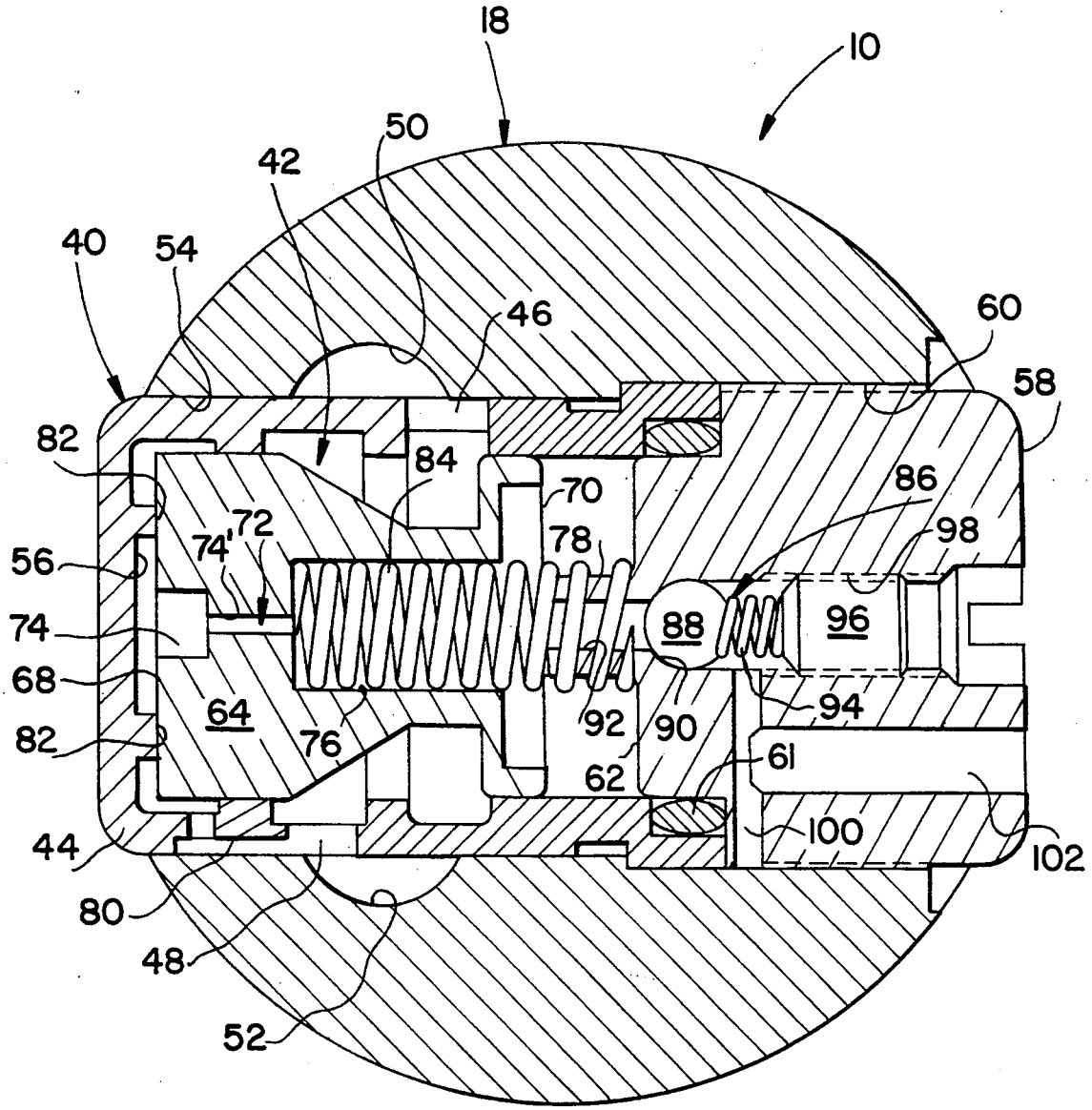
FIG. 3 is a view, partly in section, showing a pressure selecting valve of this invention.

More specifically, in the embodiment illustrated in FIG. 3, sleeve 44 is fixed in a bore 54 by any suitable conventional technique to extend across housing 18 to define valve chamber 42. A closed end of chamber 42 is provided by a wall 56 on a left end of sleeve 44 as viewed in FIG. 3. Sleeve 44 is shown having an opposite open end in abutting engagement with a plug 58. Plug 58 is screwed into an internally threaded end 60 of bore 54 in coaxial alignment with sleeve 44. Plug 58 has a double diameter inner end received within the open end of sleeve 44 and sealed by a suitable O-ring 61, whereby face 62 of plug 58 serves as a second closed end of chamber 42.

For automatically regulating motor operating pressure, a pressure selecting valve member or spool 64 is received in the valve chamber 42 for axial reciprocating movement between relatively open and relatively restricted positions respectively adjacent the left and right hand ends of chamber 42 as viewed in FIG. 3. Wall 56 of sleeve 44 provides a seat for spool 64 in its open position. Spool 64 has a "top" end 68 which is tapered to a minimum intermediate diameter portion 66 connected with a cup-shaped "bottom" end 70 which opens toward face 62 of plug 58, whereby spool 64 in cross section has a goblet-shaped configuration. An internal passage 72 is formed to extend axially through spool 64 from a first opening or orifice 74 at an end of spool 64 which is in confronting relation to the closed end wall 56 of sleeve 44. Internal passage 72 also includes a central passageway 74' which communicates with an enlarged central opening 76 (extending through a substantial portion of spool 64 to terminate at its bottom end 70) defining a second opening confronting an annular extension 78 of plug 58 formed at its double diameter inner end.

For connecting outlet port 48 and the left end of valve chamber 42 to direct motor operating pressure at the top end 68 of spool 64, a flat 80 is formed in sleeve 44 as part of internal passage 72. Internal passage 72 thus initially balances spool 64 by secondary motor pressure at both ends of the spool. It will be understood that discrete projections such as at 82 may be formed as illustrated on the closed wall 56 of sleeve 44 (or alternatively on the end of spool 64) to space spool 64 apart from sleeve 44 in the open position of spool 64 to maintain communication with outlet port 48.

To ensure that spool 64 is initially in its illustrated open position in its air balanced condition, a small, light spring 84 is seated between an inner end of the central opening 76 of the spool 64 and inner face 62 of plug 58. In this specifically illustrated embodiment, spring 84 is illustrated as a coil compression spring wrapped about annular extension 78 on plug 58 to extend into the central opening 76 of spool 64 for continuously urging it toward open position.

As the motor pressure increases from free running, through load, the motor operating pressure increases from a low level when tool 10 is running free and rises as the tool is loaded, e.g., during a fastener setting operation. That motor operating pressure is sensed by spool 64 to effect a pressure relieving action by a pilot-operated pressure reducing valve 86. In the embodiment of FIG. 3, a ball valve member 88 is normally seated against a valve seat 90 within a center passage 92 of plug 58 and is maintained in normally closed position by a small compression spring 94 having its opposite ends seated against the ball valve member 88 and an end of a set screw 96 threaded into an internally threaded portion 98 of passage 92 through plug 58. Thus, chamber 42 at the bottom end of sleeve 64 is ported through center passage 92 of plug 58. Upon being unseated when the bottom chamber pressure reaches a level adequate to overcome the biasing force of spring 94, ball valve member 88 relieves pressure at the bottom of chamber 42 to atmosphere through drilled passages 100 and 102 in plug 58.

This pressure relieving action causes a pressure differential across spool 64, causing spool 64 to move in the direction of its restricted position. The pilot valve 86 relieves only enough air to correctly position spool 64 so as to again cause a force balance on the spool. This spool repositioning is such that a restriction is thereby caused between outlet port 48 in sleeve 44 and spool 64, reducing the secondary pressure. While spool 64 is regulating, bleed from pilot valve 86 flows continuously to atmosphere; spool 64 also does not close completely during such regulating action but, rather, moves to final restricted position in a balanced condition and remains there until an unbalanced condition is experienced. E.g., upon the throttle valve 38 closing, spool 64 is caused to return to open position. Leakage from tool 10 effects return of spool 64 to open position under the biasing force of spring 84 after throttle valve 38 is moved to closed position in readiness for the next fastener setting operation.

To control stall pressure and stall torque of motor 16 to meet characteristics of different applications of the tool, the biasing force of compression spring 94 on ball valve member 88 of valve 86 may be adjusted to a desired compression setting by turning set screw 96. Adjustments are maintained with a small strip of nylon, not shown, inset into threads of set screw 96. The adjusted setting of set screw 96 may then be protected by screwing a protective end cap 104 into the plug 58.

By virtue of the above described structure, the regulator of this invention is particularly suited to incorporate a light compression spring such as at 84. Spring 84, when coupled with the air balanced feature of spool 64 and its bleed to atmosphere via the pilot-operated pressure reducing valve 86, eliminates any need for the usual heavy, pressure balancing springs found in conventional tools of this type. In addition to the simplicity of the described construction and its reduction in weight, the pressure regulator of this invention further provides for controlled flow restriction of air to motor 16 during tool loading over a wider pressure range, and therefor torque adjustment range, from free running speed to stall at a specified mean torque motor output.

Figure 4:
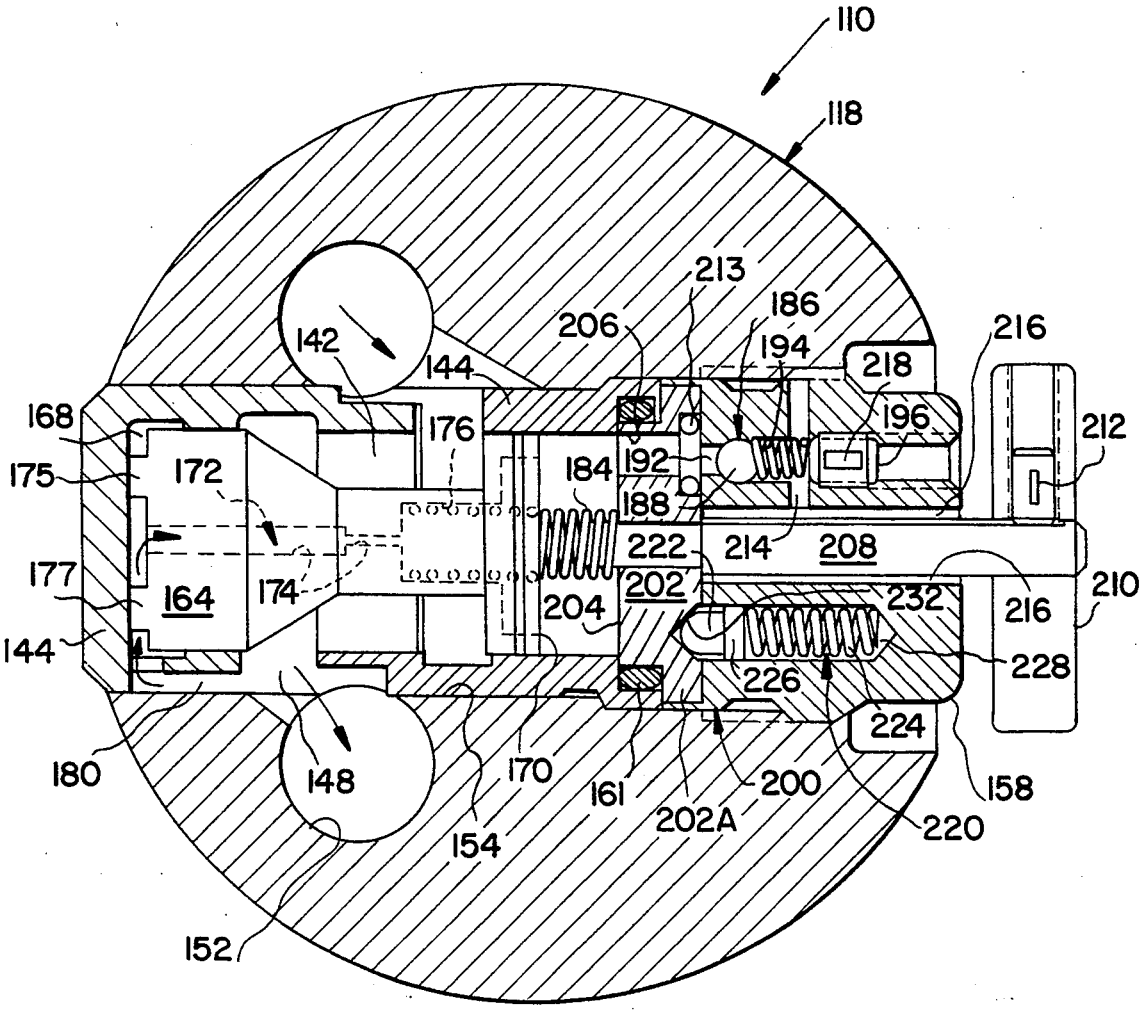
FIG. 4 is a view, partly in section, showing another embodiment of a pressure selecting valve of this invention.
Figures 5, 6:
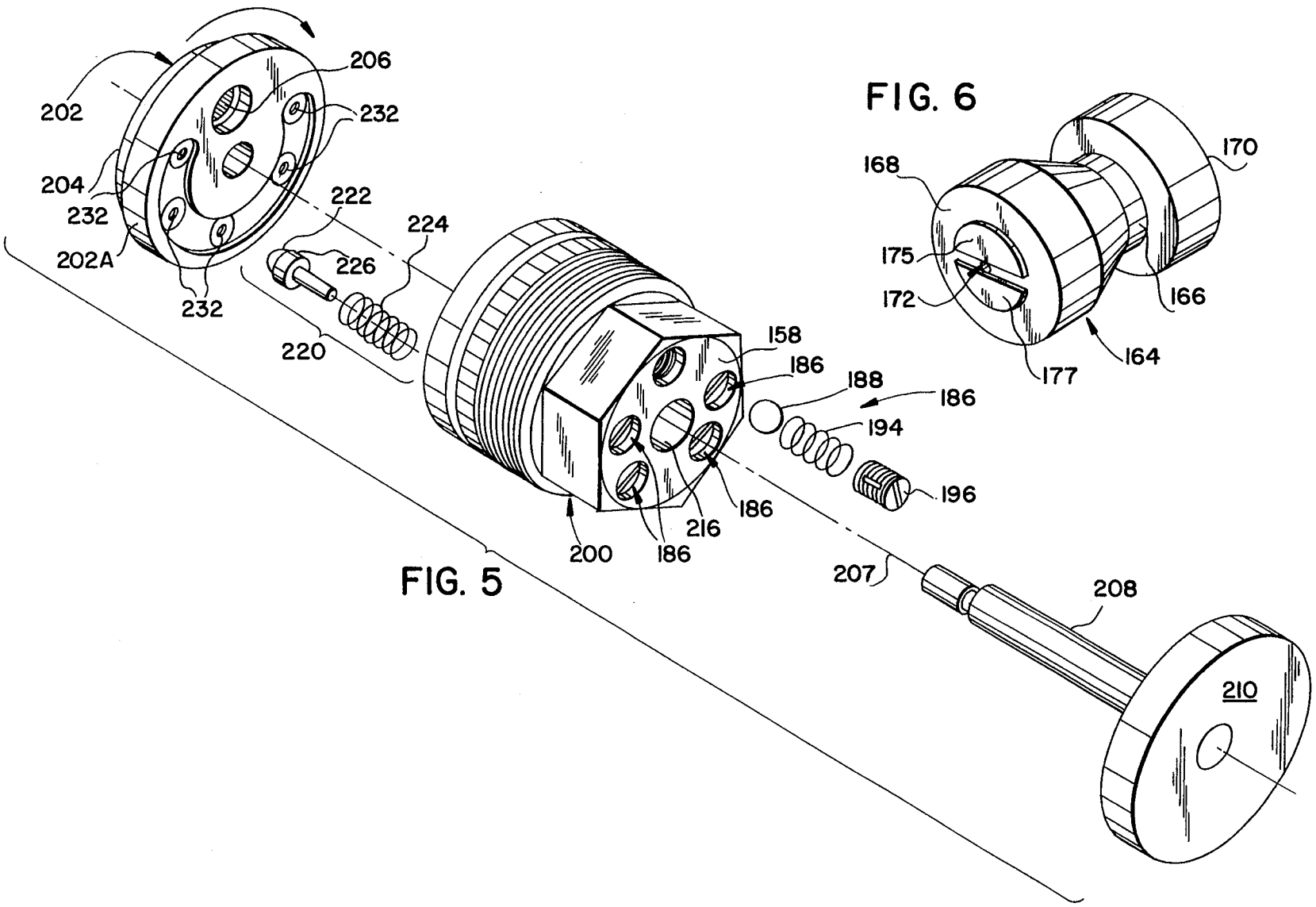
FIG. 5 is an exploded isometric view, on a reduced scale, illustrating certain component parts of the embodiment of FIG. 4.
FIG. 6 is an isometric view showing a pressure selecting valve member incorporated in the valve of FIG. 4.

Turning now to the embodiment of the invention illustrated in FIGS. 4–6, the numbers used in the above described embodiment are increased by 100 to identify similar parts in the second embodiment. A light compression spring 184 holds a goblet-shaped spool 164 in its illustrated normally open position with spool 164 being initially air balanced by secondary motor back pressure both at the top and bottom ends 168, 170 of spool 164. This secondary motor back pressure reaches a "top" end 168 of spool 164 via passage 180 formed in part by a flat on sleeve 144 and reaches the "bottom" end 170 of the spool through internal passage 172. This passage 172 contains reduced center orifice portions 174, 174' which communicate with opening 176 of spool 164. As best seen in FIG. 6, "top" end 168 is shown having raised bosses at 175, 177 to maintain spool 164 in spaced relation to sleeve 144 to ensure continuous communication of passage 172 with outlet port 148 leading via passageway portion 152 to motor 16.

In this second embodiment, quick and easy torque adjustment is effected by a selectable set torque device 200. To provide such quick and easy adjustment, a plurality of pressure relief pilot valves 186 are provided with each of the pilot valves being adjusted to a different specified tool output torque. As in the first embodiment, chamber 142 at the "bottom" end of the valve 164 is ported through a selected one of the pilot valves 186. To provide adjustability, a selector disc 202 is received within the housing bore 154 for rotary movement on an open end of sleeve 144. In the specifically illustrated embodiment, disc 202 has a reduced inner end 204, received within sleeve 144 and sealed by a suitable elastomeric O-ring 161, and an enlarged diameter portion 202A of the selector disc 202 is rotatably supported on an end face of sleeve 144. For communicating the "bottom" end of chamber 142 with any one of the pressure relief pilot valves, such as the one shown at 186 in FIG. 4, the selector disc 202 has a passage 206 therethrough. The pilot valves 186 are formed in plug 158 in a concentric arrangement (best seen in FIG. 5) relative to an axis of movement of spool 164 which will be understood to be coincident with a major axis 207 of plug 158 and disc 202. Each of the pressure relief pilot valves 186 may be identical, in both structure and function, to that described in connection with the pilot-operated pressure reducing valve of the first embodiment. Selector disc 202 is shown fixed to a shaft 208 extending axially outwardly of housing 118. A manually operated knob 210 is secured by a set screw 212 (FIG. 4) to shaft 208 for rotating disc 202 to align a given pilot valve 186 with passage 206 of disc 202. The connection between disc passage 206 and valve passage 192 of a given pilot valve 186 is shown in FIG. 4 sealed by a suitable O-ring 213 fitted within a concentric enlarged end opening of passage 206 in disc 202 in confronting relation to plug 158. Each of the pressure relief pilot valves 186 will be understood to have a radial drilled passage such as that illustrated at 214 in FIG. 4 in communication with a central opening 216 in plug 158 to communicate the "bottom" of chamber 142 with atmosphere upon ball valve member 188 being unseated against the biasing force of its spring 194 responsive to increased motor operating pressure to effect the unbalancing of spool 164 for pressure regulation as fully described above in connection with the first embodiment.

To set different specified torques, e.g., for set torques of 40 Newton-meters (Nm), 35 Nm, 30 Nm, and 27.5 Nm, and 25 Nm, the disclosed multiple torque selection device 200 is uniquely adapted for such adjustment in a particularly quick and easy fashion. Each of the illustrated pilot valves, five such valves 186 being shown in the specifically illustrated embodiment (FIG. 5), can be easily adjusted to one of these specified tool output torque settings by adjusting a compression setting on spring 194 by rotating set screw 196 against which spring 194 is seated. Such adjustment is maintained as described above with a small strip of nylon illustrated at 218 which is inset into threads of set screw 196.

To maintain a given tool output torque selection, a detent device 220 is shown which is illustrated as being mounted in plug 158 with a plunger 222 biased by a spring 224 having its opposite ends seated against a collar 226 of plunger 222 and a bottom of a blind hole 228 in plug 158. The detent device 220 is received in any one of five different detent-receiving cavities illustrated as being formed at 232 in the selector disc 202. As will be readily seen, detent 220 could be mounted alternatively in selector disc 202 and the detent-receiving cavities 232 could be formed in the housing member or plug 158, either arrangement being equally satisfactory providing that cavities 232 are in corresponding relation to pilot valves 186 for selectively registering chamber 142 and passage 206 with a selected pilot valve 186. It will be seen that detent 220 preferably is disposed in 180° angular displacement from passage 206.

It will be appreciated by those skilled in the art that the simplicity of the enclosed design provides that it may be quickly and easily manufactured and assembled at low cost to provide a compact tool construction incorporating a minimum number of parts for extended service under demanding conditions.

As will be apparent to persons skilled in the art, various modifications, adaptations, and variations of the foregoing specific disclosure can be made without departing from the teachings of this invention.

I claim:

1. An air operated fastener setting tool comprising an air motor, a housing for the motor, the housing having a passageway for supplying air under pressure to the motor, an on-off control mounted in the housing for establishing open and closed air flow conditions in the passageway, a pressure regulator mounted in the housing between the on-off control and the motor, the pressure regulator including a valve chamber having an inlet port and an outlet port, the on-off control and the motor communicating through the passageway respectively with the inlet and outlet ports, a pressure selecting valve member reciprocable in the chamber between a relatively open position and a relatively restricted position, a spring mounted in the chamber biasing the pressure selecting valve member toward open position, and passage means for directing air pressure on the motor side of the pressure selecting valve member against its opposite ends such that it is initially air balanced and biased by the spring into open position upon the on-off control establishing the open air flow condition, and a pressure relief pilot valve mounted in the housing for connecting the chamber with atmosphere and creating a pressure differential between opposite ends of the pressure selecting valve member for moving it toward restricted position responsive to increased motor operating pressure to restrict the outlet port and reduce air pressure on the motor side of the regulator whereby, when the motor operating pressure increases as load is applied to the motor output, the pressure selecting valve member is automatically positioned in a force balanced condition within the chamber for motor pressure regulation throughout a range of running conditions from free running speed to stall at a specified mean torque motor output, further including a plurality of pressure relief pilot valves mounted in the housing for connecting the chamber with atmosphere, each of the pilot valves being adjusted to a different specified tool output torque, and a manually operable selector mounted within the housing and having a passage for selectively registering the chamber with any one of the pressure relief pilot valves for connecting the chamber with atmosphere and quickly establishing a previously adjusted specified tool output torque.

2. The tool of claim 1 further including a detent mounted in one of the housing and selector members, and a detent-receiving cavity means formed in the other of the housing and selector members for releasably receiving the detent and maintaining the selector in a desired adjusted tool output torque setting.

3. The tool of claim 1 wherein the pressure relief pilot valves are mounted in the housing in a concentric arrangement relative to an axis of reciprocation of the pressure selecting valve member, wherein a detent is mounted in the housing, and wherein the selector includes a selector disc received in the housing for rotary movement, the selector disc having a passage therethrough for communicating the chamber with any one of the pressure relief pilot valves, and a plurality of detent-receiving cavities formed in the selector disc in corresponding relation to the pressure relief pilot valves for releasably receiving the detent and selectively registering the chamber and the selector passage with one of the pilot valves.

4. The tool of claim 3 further including a shaft fixed to the disc to extend axially therefrom, and a manually operated knob secured to the shaft for selecting a given pilot valve for establishing a previously adjusted specified tool output torque setting for the tool.

5. The tool of claim 1 wherein bleed from the pressure relief pilot valve to atmosphere is continuous during pressure regulation by the pressure selecting valve member.

6. The tool of claim 1 wherein the pressure selecting valve member automatically shifts into its restricted position against the biasing force of the spring upon motor stall at said specified mean torque motor output responsive to increased torque load on the motor.

7. In an air operated fastener setting tool having an air motor, a housing for the motor, the housing having a passageway for supplying air under pressure to the motor, and a pressure regulator mounted in the housing, the pressure regulator including a valve chamber having an inlet port and an outlet port connected to the passageway with a pressure selecting valve member movable in the chamber between a relatively open position and a relatively restricted position respectively establishing relatively open flow and restricted flow conditions in the chamber between said ports, a spring biasing the pressure selecting valve member toward its open position, and passage means for directing air pressure on the motor side of the pressure selecting valve member against its opposite ends such that it is initially air balanced and biased by the spring toward open position, a selectable set torque device comprising a plurality of pressure relief pilot valves in the housing for connecting the chamber with atmosphere, each of the pilot valves being adjusted to a different specified tool output torque, and a manually operable selector mounted within the housing and having a passage in communication with the chamber, the passage being selectively registrable with any one of the pressure relief pilot valves for connecting the chamber with atmosphere and quickly establishing a previously adjusted specified tool output torque.

8. The device of claim 7 further including a detent mounted in one of the housing and selector members, and a detent-receiving cavity means formed in the other of the housing and selector members for releasably receiving the detent and maintaining the selector in a desired adjusted preselected tool output torque setting.

9. The device of claim 7 wherein said pressure relief pilot valves are mounted in the housing in a concentric arrangement relative to an axis of movement of the pressure selecting valve member, wherein a detent is mounted in the housing, wherein the selector includes a selector disc received in the housing for rotary movement with the passage formed to extend therethrough, and wherein a plurality of detent-receiving cavities are formed in the selector disc in corresponding relation to the pressure relief pilot valves for releasably receiving the detent and selectively registering the chamber and the selector passage with one of the pilot valves.

10. The device of claim 7 further including a shaft fixed to the disc to extend axially therefrom, and a manually operated knob secured to the shaft for selecting a given pilot valve for establishing a previously adjusted specified tool output torque setting for the tool.

11. The device of claim 7 wherein bleed to atmosphere from a pressure relief pilot valve in registration with the chamber is continuous during pressure regulation by the pressure selecting valve.

12. The device of claim 7 wherein each of the pressure relief pilot valves is mounted in the housing and includes a pressure relief valve passage communicating with atmosphere, the pressure relief valve passage having a valve seat therein and a ball valve member received in the valve passage, a spring received in the valve passage, and an adjusting screw mounted in the housing, the spring having its opposite ends seated against the adjusting screw and the ball valve member for biasing the ball valve member toward the valve seat for closing the pressure relief valve passage, and the adjusting screw providing an adjustable force against the ball valve member for relieving valve chamber pressure to atmosphere upon the ball valve member being unseated responsive to back pressure from the motor reaching a predetermined level, thereby to regulate the motor operating pressure and effect said specified mean torque motor output.

13. The device of claim 12 wherein the pressure selecting valve member and the outlet port coact to provide a variable restriction on the motor side of the regulator as load is applied to the motor output, and wherein the spring biasing force on the ball valve member and the variable restriction at the outlet port coact for controlling the pressure and torque at which the motor will stall.

* * * * *